US006588592B2

(12) United States Patent
Falls et al.

(10) Patent No.: US 6,588,592 B2
(45) Date of Patent: Jul. 8, 2003

(54) LIGHT-TIGHT FILM PACKAGE

(75) Inventors: Thomas F. Falls, Hilton, NY (US); Walter A. Brink, Fort Collins, CO (US); Connie L. Magnuson, Fort Collins, CO (US); Friedrich Ueffinger, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 30 days.

(21) Appl. No.: 09/910,100

(22) Filed: Jul. 20, 2001

(65) Prior Publication Data

US 2003/0015449 A1 Jan. 23, 2003

(51) Int. Cl.[7] ..... B65D 81/30
(52) U.S. Cl. ..... 206/455; 378/184; 396/518
(58) Field of Search ..... 206/455; 378/182–184; 396/517, 518

(56) References Cited

U.S. PATENT DOCUMENTS

| | | | | |
|---|---|---|---|---|
| 3,741,386 A | | 6/1973 | Schmidt | 206/62 R |
| 4,909,389 A | | 3/1990 | Plessers et al. | 206/451 |
| 4,933,696 A | | 6/1990 | Schmidt et al. | 354/277 |
| 5,008,694 A | | 4/1991 | Tajima et al. | 354/277 |
| 5,251,755 A | | 10/1993 | Kausch | 206/455 |
| 5,649,411 A | * | 7/1997 | Dirx | 206/455 |
| 2002/0004179 A1 | * | 1/2002 | Nishiyama | 206/455 |

FOREIGN PATENT DOCUMENTS

| | | |
|---|---|---|
| EP | 0 250 851 A2 | 5/1987 |
| EP | 0 313 686 A1 | 10/1987 |

OTHER PUBLICATIONS

PCT International Application, No. WO 99/37541, Publication Date: Jul. 29, 1999, Title: Bag Closing Method and Apparatus.

* cited by examiner

*Primary Examiner*—Jim Foster
(74) *Attorney, Agent, or Firm*—Susan L. Parulski

(57) ABSTRACT

A package for enclosing a plurality of sheets. The package comprises a pouch adapted to receive the plurality of sheets, a leader, and a closure member. The pouch comprises a leading end and a trailing end opposite the leading end. The trailing end is open to receive the plurality of sheets. The trailing end is folded back at least once to form a closure flap to light-tightly close the pouch. The leader is disposed at the leading end of the pouch and is folded back onto the pouch. The closure member includes a first end affixed to the leader, a second end affixed to the closure flap, and a rupturable portion disposed adjacent the first end. When the rupturable portion is ruptured, the first end separates from the closure member and adheres to leader while the remaining portion of the closure member adheres to the closure flap by the second end.

29 Claims, 12 Drawing Sheets

LIGHT-TIGHT FILM PACKAGE

FIELD OF THE INVENTION

The present invention relates generally to a film package, and more particularly to a package for storing a plurality of sheet film therein.

BACKGROUND OF THE INVENTION

Sheets of material, such as paper and film, are generally packaged for sale and/or transport. If the sheet material is comprised of a photosensitive material, such packaging needs to be light-tight so as to not adversely affect the photosensitive characteristics of the sheet material prior to use.

For example, radiation image films are widely used in the medical field for photographing objects such as human bodies with x-rays for medical diagnosis. The x-ray film sheets are stored in a magazine or cassette and taken out one-by-one by a sheet delivery system. Such x-ray sheet film is photosensitive, so the packaging for sale and/or transport must be light-tight.

Further, when loading the x-ray film sheets into the magazine, they must not be exposed to extraneous light. Accordingly, it had been general practice to load the sheet film into the magazine or cassette (or other package receiving device) in a dark room. However, since the efficiency of such a loading process is low, there is a demand for loading x-ray sheet film in a day-light or room-light (i.e., ordinary light) environment/conditions.

Various methods have been proposed for light-tight packages for loading x-ray film sheets in a room light environment. Examples of x-ray film packages and light-tight film sheet packages are disclosed in U.S. Pat. No. 5,251,755 (Kausch) commonly assigned and incorporated herein by reference, U.S. Pat. No. 4,909,389 (Plessers et al.), U.S. Pat. No. 5,008,694 (Tajima et al), U.S. Pat. No. 3,741,386 (Schmidt) and U.S. Pat. No. 4,933,696 (Schmidt et al.).

While such apparatus may have achieved certain degrees of success in their particular applications, a need continues to exist for a robust light-tight film sheet package which can be readily loaded in a magazine/cassette in day-light conditions while not adversely affecting any photosensitive characteristics of the film sheets.

Accordingly, a need continues to exist for a light-tight package adapted to be loaded into a package receiving device while maintaining light integrity.

SUMMARY OF THE INVENTION

An object of the present invention is to provide a light-tight film sheet package.

Another object of the invention is to provide such a light-tight package which can be loaded into a package receiving device in room light conditions.

These objects are given only by way of illustrative example. Thus, other desirable objectives and advantages inherently achieved by the disclosed invention may occur or become apparent to those skilled in the art. The invention is defined by the appended claims.

According to one aspect of the invention, there is provided a package for enclosing a plurality of sheets. The package comprises a pouch adapted to receive the plurality of sheets, a leader, and a closure member. The pouch comprises a leading end and open along a trailing end opposite the leading end to receive the plurality of sheets. The trailing end is folded back at least once to form a closure flap to light-tightly close the pouch. The leader is attached to the pouch at the leading end and is folded back onto the pouch. The closure member includes a first end affixed to the leader, a second end affixed to the closure flap, and a rupturable portion disposed adjacent the first end. When the rupturable portion is ruptured, the first end separates from the closure member and adheres to leader while the remaining portion of the closure member adheres to the closure flap by the second end.

According to another aspect of the present invention, there is provided a package for enclosing a plurality of sheets comprising a pouch, a leader, and at lease one closure member. The pouch is adapted to receive the plurality of sheets, and comprises a leading end and a trailing end opposite the leading end. The pouch is open along the trailing end to receive the plurality of sheets, with the trailing end being folded back at least once to form a closure flap to light-tightly close the pouch. The leader is disposed at the leading end of the pouch and folded back onto the pouch. The at least one closure member includes a first end, a second end, a top side, and a bottom side, a first attachment area disposed at the first end on the bottom side, a second attachment area disposed at the second end on the bottom side, a non-attachment area disposed on the bottom side intermediate the first and second attachment areas, an adhesive disposed on the first and second attachment areas, and a rupturable portion disposed at the first end adjacent the first attachment area. The first attachment area is adhered to the leader. The second attachment area is adhered to the closure flap, such that when the rupturable portion is ruptured, the first end separates from the closure member and adheres to the leader at the first attachment area and the remaining portion of the closure member adheres to the closure flap at the second attachment area.

The present invention provides a light-tight package adapted to be loaded into a package receiving device in room light conditions.

BRIEF DESCRIPTION OF THE DRAWINGS

The foregoing and other objects, features, and advantages of the invention will be apparent from the following more particular description of the preferred embodiments of the invention, as illustrated in the accompanying drawings.

DETAILED DESCRIPTION OF THE INVENTION

Figure 1:
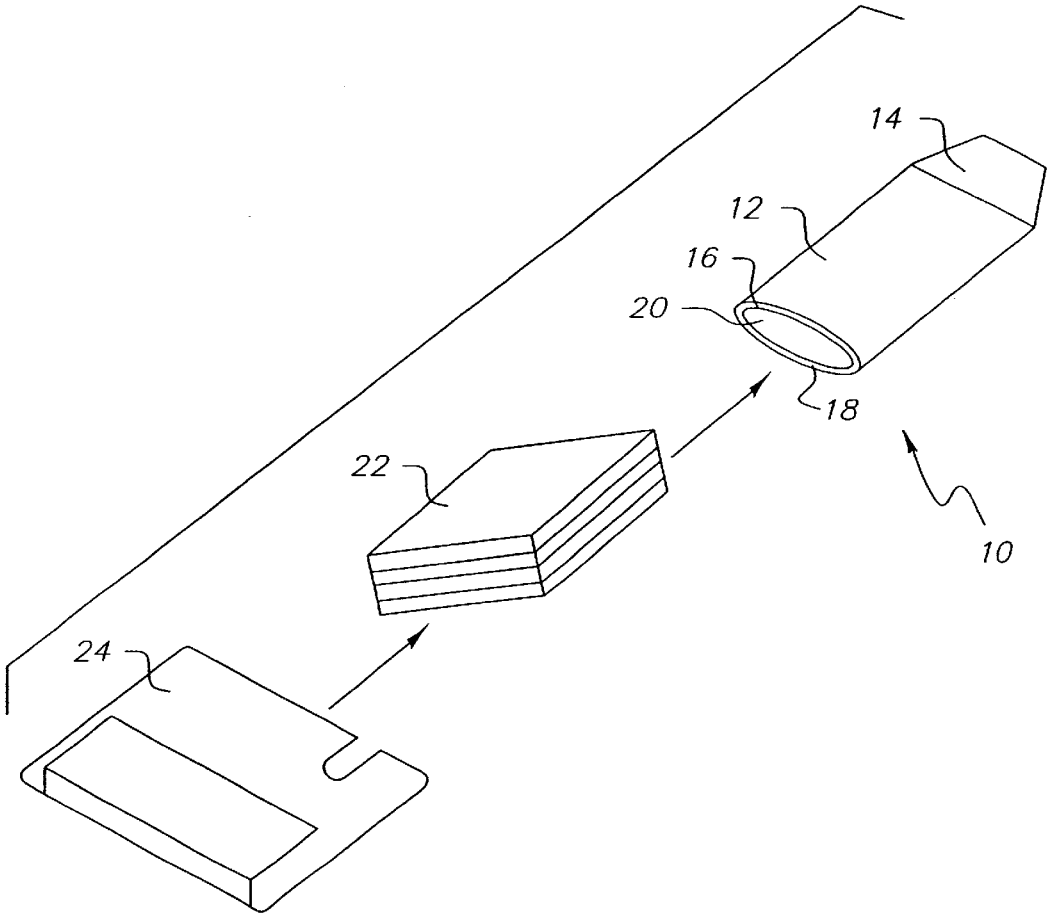
FIG. 1 shows a perspective view of a stack of film sheets being loaded into a package.

The following is a detailed description of the preferred embodiments of the invention, reference being made to the drawings in which the same reference numerals identify the same elements of structure in each of the several figures.

Referring now to FIG. 1, a package 10 in accordance with the present invention comprises a pouch 12 and a leader 14. Pouch 12 can be formed from one sheet, or alternatively, from two generally rectangular sheets 16,18 of packaging material. Various materials are suitable for use in making pouch 12 and leader 14. Sheets 16, 18 and leader 14 are comprised of a non-rigid, flexible material. If the film sheets disposed within package 10 are photosensitive, sheets 16,18 is comprised of an opaque and moisture barrier material so as to not adversely affect the photosensitive characteristics of the film sheets. For example, sheets 16,18 can be made of black modified high density polyethylene, a linear low density polyethylene, or a polypropylene. Sheets 16,18 are located one above the other in generally parallel planes. They are secured together along three side edges thereof to form an interior space. The fourth side is open to form an opening 20, through which a stack 22 of film sheets is loaded into the interior space of pouch 12. Sheets 16,18 may be joined by heat sealing or other joining means known to those skilled in the art. Sheets 16,18 define a top and bottom face, respectively, of pouch 12.

As is known in to those skilled in the art, an additional layer(s) may optionally be provided to one or both sides of stack 22 of film sheets prior to being disposed within pouch 12. The additional layer(s) may be employed to strengthen the stack, protect the stack, and/or facilitate handling of the stack both before and after introduction into a magazine/cassette. As illustrated in FIG. 1, an additional layer is shown as a paperboard folder 24.

Leader 14 is disposed along a side edge of pouch 12 opposite opening 20. Leader 14 may be integral to pouch 12, or may joined to the side edge by heat sealing or other joining means known to those skilled in the art. As with sheets 16,18, leader 14 may be made of polyethylene or polypropylene, however, leader 14 need not be of an opaque material as it is not directly shielding the film sheets.

Figure 2:
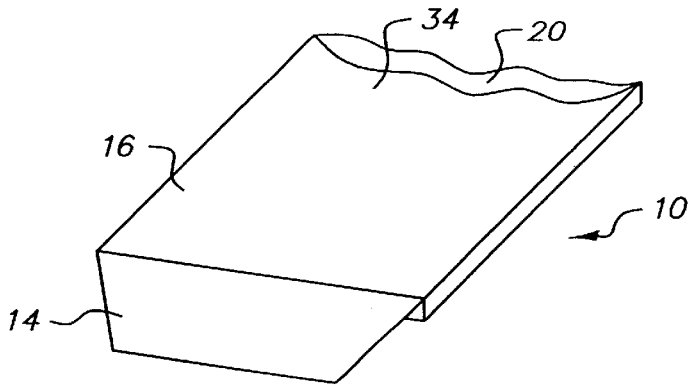
FIG. 2 shows a perspective view of the package of FIG. 1 with the stack of film sheets loaded within and one end open.
Figure 3:
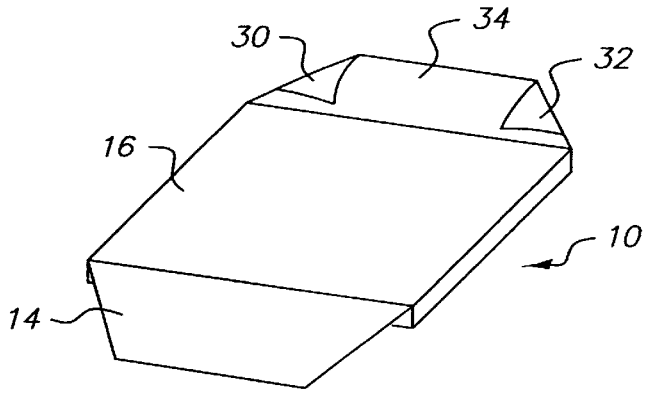
FIG. 3 shows a perspective view of the package of FIG. 2 with the open end folded.
Figure 4:
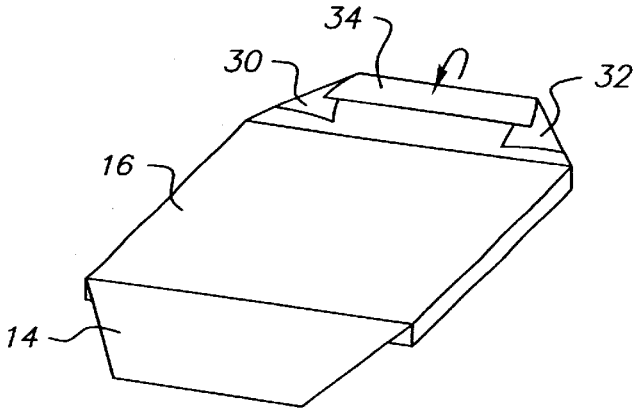
FIG. 4 shows a perspective view of the package of FIG. 3 with the open end further folded to form a closure flap.
Figure 5:
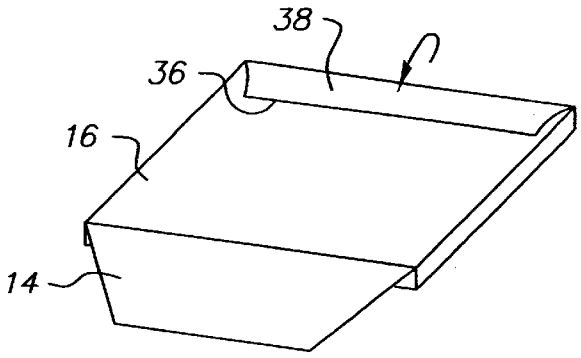
FIG. 5 shows a perspective view of the package of FIG. 4 with the open end further folded.

FIG. 2 shows package 10 having stack 22 of film sheets disposed within the interior of pouch 12, with opening 20 in an open arrangement. Opening 20 is now folded to close opening 20 and secure stacks 22 within pouch 12, thereby forming a light-tight enclosure of pouch 12. FIGS. 3–5 show one method for closing opening 20. Side ends 30,32 of opening 20 of pouch 12 are folded over 90 degrees so that a configuration as shown in FIG. 3 is obtained. As best shown in FIG. 4, edge 34 of opening 20 is then folded over 180 degrees to cover a portion of (or all of) side ends 30,32 to form a folded-over portion. The folded-over portion is then folded over 180 degrees onto sheet 16 as best illustrated in FIG. 5, forming a closure flap 38 having a front edge 36 adjacent one side of pouch 12, which is shown as sheet 16 in FIG. 5.

Figure 6:
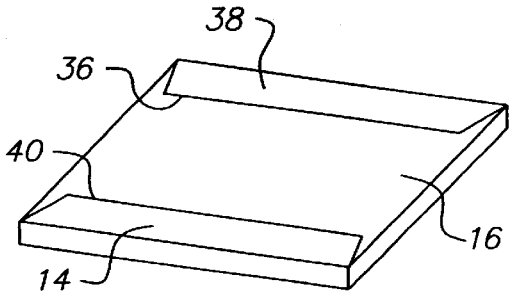
FIG. 6 shows a perspective view of the package of FIG. 5 with the leader folded back onto the pouch.

Leader 14 is folded back onto pouch 12, shown as being folded back onto sheet 16 in FIG. 6. As shown, a front edge 40 of leader 14 is directed toward front edge 36 of closure flap 38. In FIG. 6, pouch 12, leader 14, and closure flap 38 are sized such that front edge 40 is spaced from front edge 36. However, leader 14 might overlap closure flap depending on the size of pouch 12.

Figure 7:
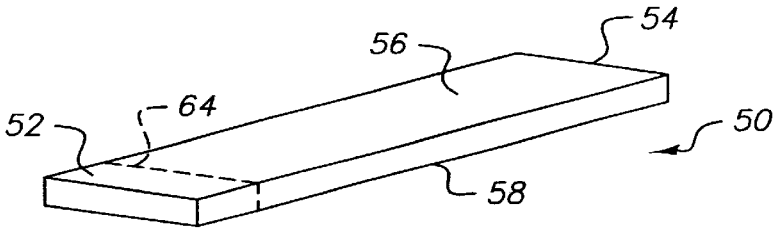
FIG. 7 shows a perspective view of a closure member in accordance with the present invention.
Figure 8:
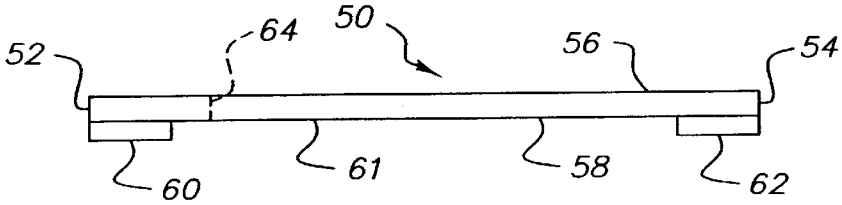
FIG. 8 shows a side view of the closure member of FIG. 7.

A closure member 50 is applied to leader 14 and closure flap 38 to close/secure leader 14 and closure flap 38 in position. As shown in FIGS. 7–8, closure member 50 is shown as a strip having a first end 52, a second end 54, a top side 56, a bottom side 58, and rupturable means such as rupturable portion 64. Closure member 50 is preferably a flexible member able to be put into tension and resist tearing. Suitable materials for closure member 50 include polypropylene, polyolefin, polyester, or paper. In a preferred embodiment, closure member 50 is comprised of a white biaxially oriented polypropylene.

Disposed on bottom side 58 adjacent first end 52 is a first attachment area 60. Disposed on bottom side 58 adjacent second end 54 is a second attachment area 62. First attachment area 60 is spaced from second attachment area 62 such that a non-attachment area 61 is disposed on bottom side 58 intermediate first and second attachment areas 60,62. In a preferred embodiment, first and second attachment areas 60,62 comprise an adhesive.

Figure 9:
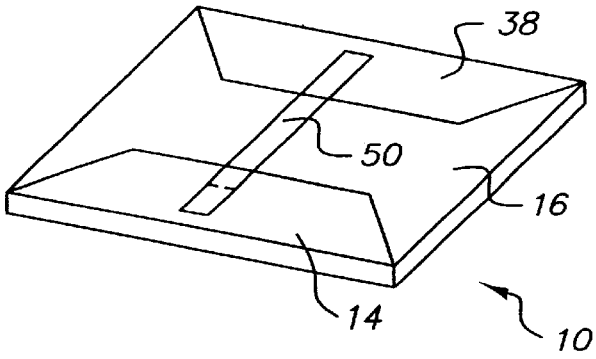
FIG. 9 shows a perspective view of a light-tight package in accordance with the present invention.
Figure 10:
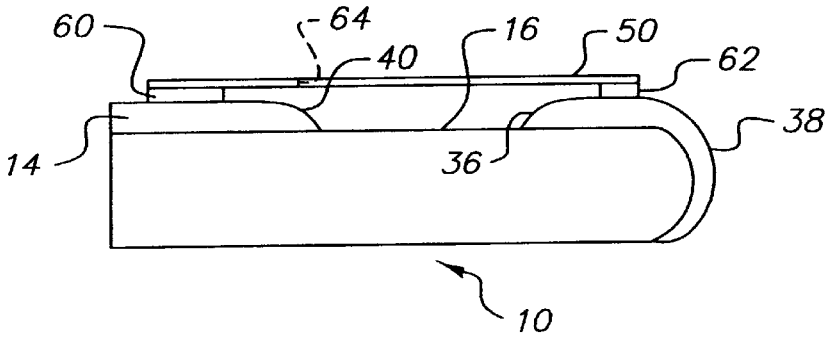
FIG. 10 shows a side view of the package of FIG. 9.
Figure 11:
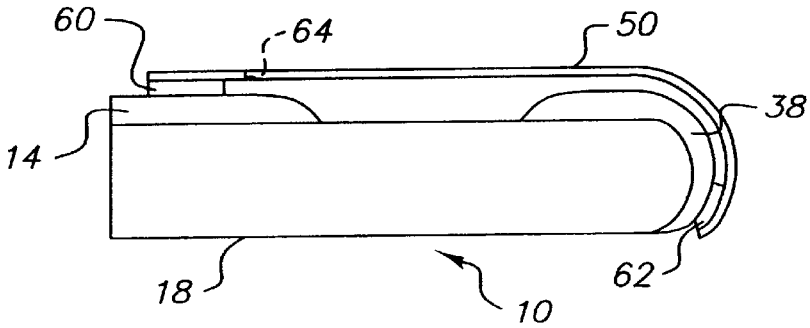
FIG. 11 shows a side view of the package of the present invention wherein the closure member is disposed at another position on the closure flap.

Referring now to FIGS. 9–11, package 10 is formed by placing closure member 50 in slight tension and affixing/adhering first attachment area 60 to leader 14, and affixing/adhering second attachment area 62 to closure flap 38. As such, closure member 50 secures closure flap 38 and leader 14 in position. Since first attachment area 60 is spaced from second attachment area 62 (with non-attachment area 61 disposed intermediate first and second attachment areas 60,62), closure member 50 is not affixed to pouch 12, which is illustrated in FIG. 10 as sheet 16. Rather, closure member 50 is configured as a "strap".

Closure member 50 can be affixed to leader 14 at any location; it need not be affixed adjacent front edge 40. Similarly, closure member 50 can be affixed to closure flap 38 at any location; it need not be affixed adjacent front edge 36. For example, as illustrated in FIG. 11, attachment area 62 is applied to closure flap 38 at a location away from front edge 36.

The adhesive of first attachment area 60 must be suitable to aggressively adhere to leader 14 to secure leader 14 to closure member 50, while the adhesive of second attachment area 62 must be suitable to aggressively adhere to closure flap 38 to secure closure flap 38 to closure member 50. Those skilled in the art will be familiar with suitable adhesives, for example, an acrylic based pressure sensitive adhesive, a water activated adhesive, a solvent adhesive, or heat activated adhesive. A peel-away liner may be employed to shield the adhesive until use; upon use, the liner would be peeled away to expose the adhesive.

First and second attachment areas might be affixed to closure member 50 through means other than adhesive, for example heating sealing or other non-destructive sealing/affixing means known to those skilled in the art.

Closure member 50 further comprises rupturable means such as rupturable portion 64 disposed at first end 52 adjacent first attachment area 60. Rupturable portion 64 is not disposed within first attachment area 60. Rupturable portion 64 may be for example perforations (as shown in FIG. 7), a plurality of minute holes, and/or a combination thereof, as is well known to those skilled in the art. Rupturable portion 64 might also be a notch/tear in an edge of closure member 50.

Figure 12:
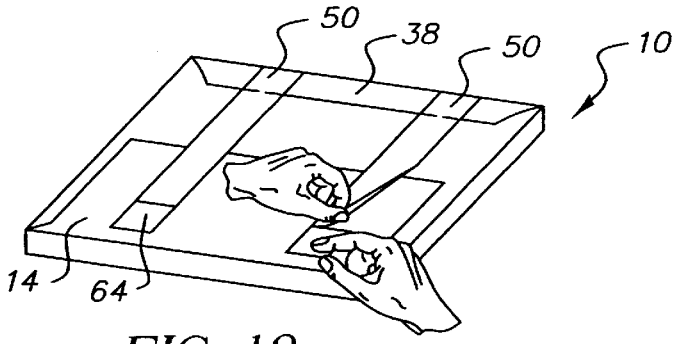
FIG. 12 shows a perspective view of the package of FIG. 9 having two closure members.

In a preferred embodiment, two closure members 50 are employed with package 10 as illustrated in FIG. 12, with each applied toward the outside edges of pouch 12 to ensure fold integrity.

Figure 13:
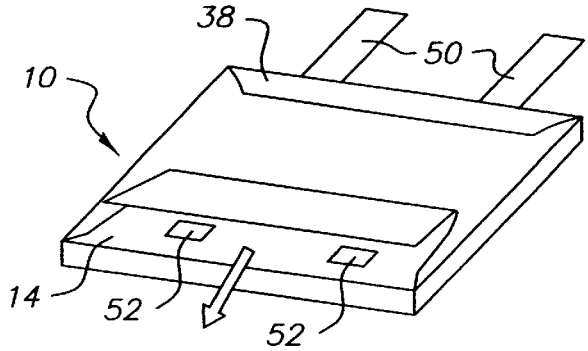
FIG. 13 shows a perspective view of the package of FIG. 12 with the closure members ruptured.
Figure 14:
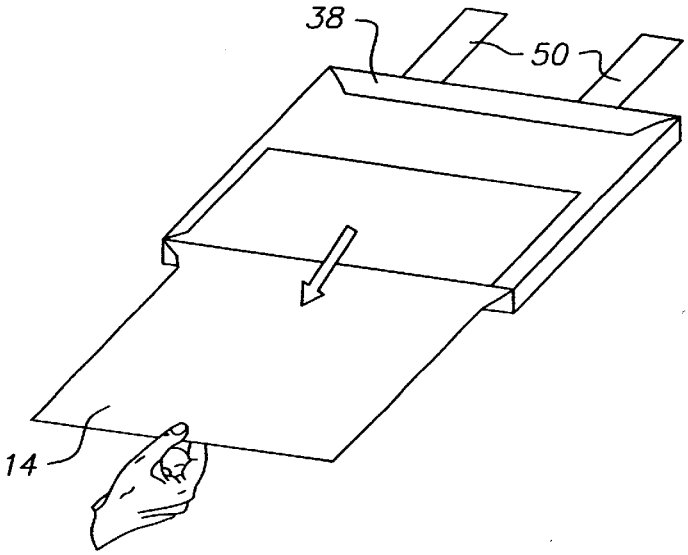
FIG. 14 shows a perspective view of the package of FIG. 12 with the closure members ruptured and the leader extended.

Referring now to FIGS. 12–14, to open package 10, a user grasps closure member 50 and ruptures rupturable portion 64. The puncturing/rupturing/tearing of rupturable portion 64 causes first end 52 to separate from closure member 50. That is, first end 52 remains adhered to leader 14 at first attachment area 60 while the remaining portion of closure member 50 remains adhered to closure flap 38 by means of second attachment area 62. Leader 14 is now free to be folded away from pouch 12 while closure flap 38 may be unfolded to access stack 22 of film sheets.

Figure 15A:
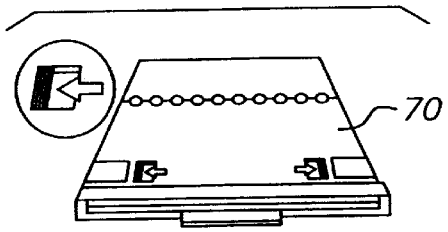
FIGS. 15*a*–15*i* show perspective views illustrating the use of the package of FIG. 12 in a cassette.
Figure 15B:
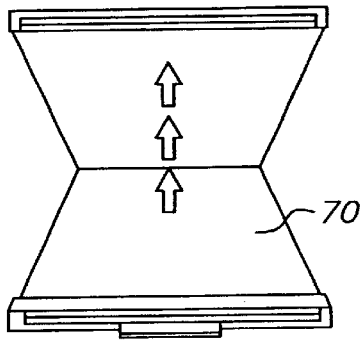
Figure 15C:
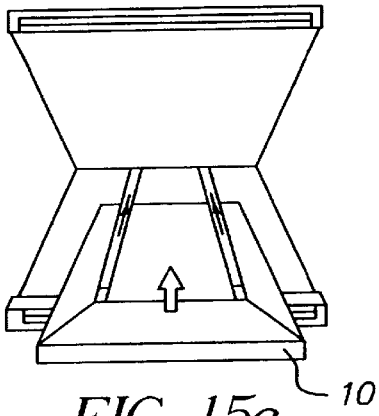
Figure 15D:
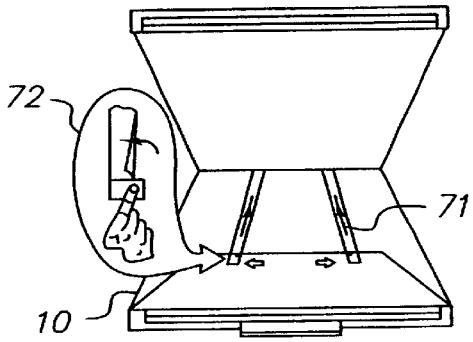
Figure 15E:
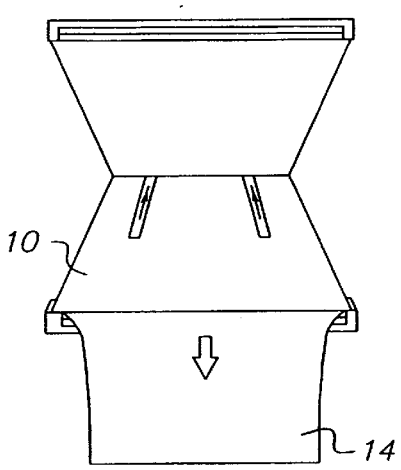
Figure 15F:
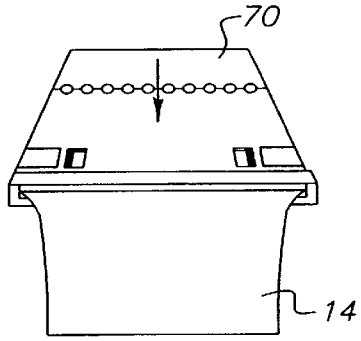
Figure 15G:
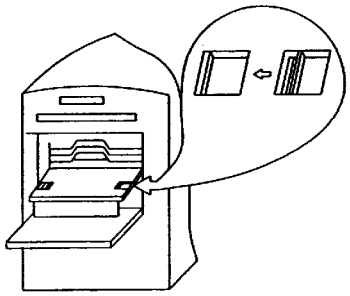
Figure 15H:
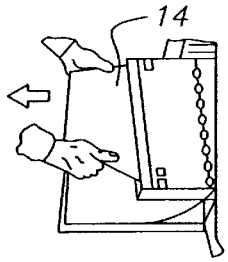
Figure 15I:
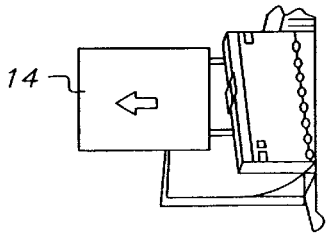
Figure 15J:
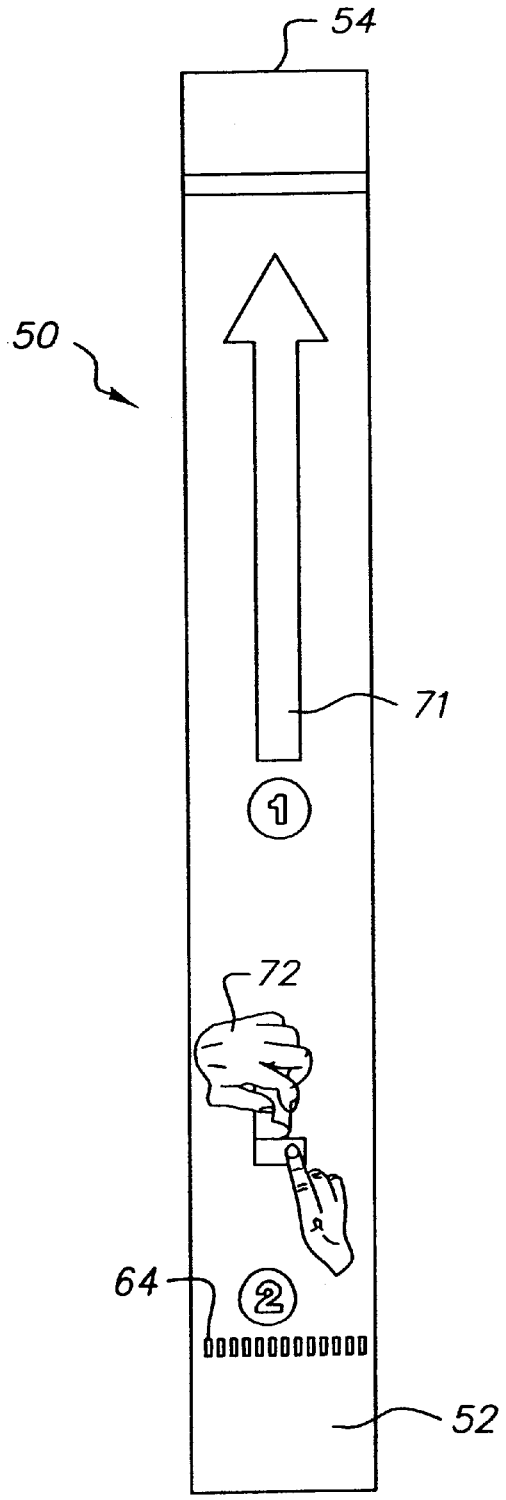
FIG. 15*j* shows a top view of a closure member.

In a preferred embodiment, the magazine or cassette provides ready access to closure member 50. A preferred cassette is shown in FIGS. 15*a*–15*i* wherein a cassette 70 is adapted to move between a closed position and an open position to receive package 10 therein. In the open position, a user positions package 10 within cassette 70. The user then ruptures rupturable portion 64 of both closure members 50 (FIG. 15*d*). As shown in FIG. 15*e*, leader 14 can then be folded away from pouch 12. The cassette is closed with leader 14 extending outside of cassette 70 (FIG. 15*f*). Cassette 70 is inserted into a receiving member, such as x-ray equipment, as is shown in FIG. 15*g*, wherein the user pulls leader 14 to separate pouch 12 from stack 22. That is, pouch 12 is removed from the cassette, and stack 22 remains within the cassette.

Closure member 50 may comprise one or a plurality of alphanumeric or iconic characters, images, and/or illustrations. For example, as shown in FIGS. 15*c*–15 *e* and 15*j*, an arrow 71 or image 72 may be disposed on closure member 50 to assist in directing the user in inserting package 10 in the cassette.

Figure 16:
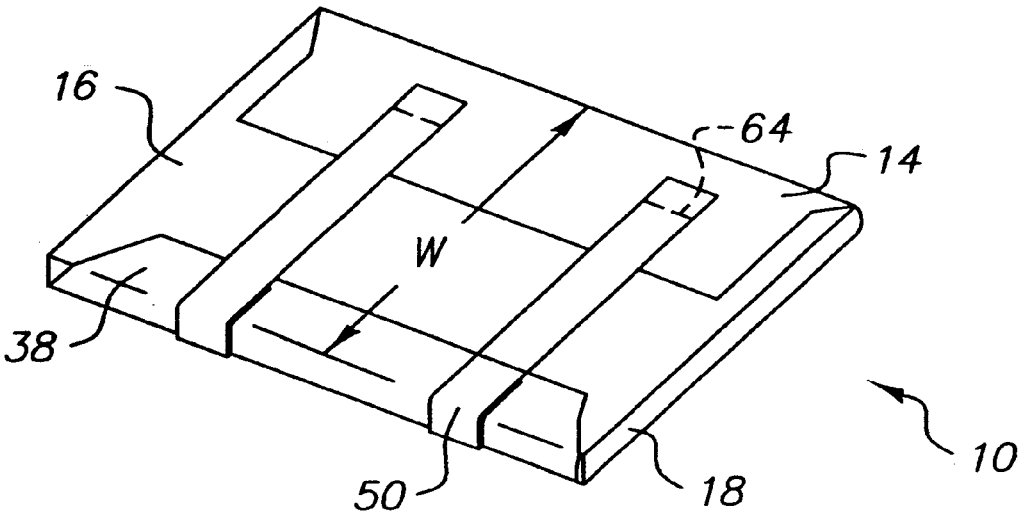
FIG. 16 shows a perspective view of a package in accordance with the present invention with a closure member folded back on itself.
Figure 17:
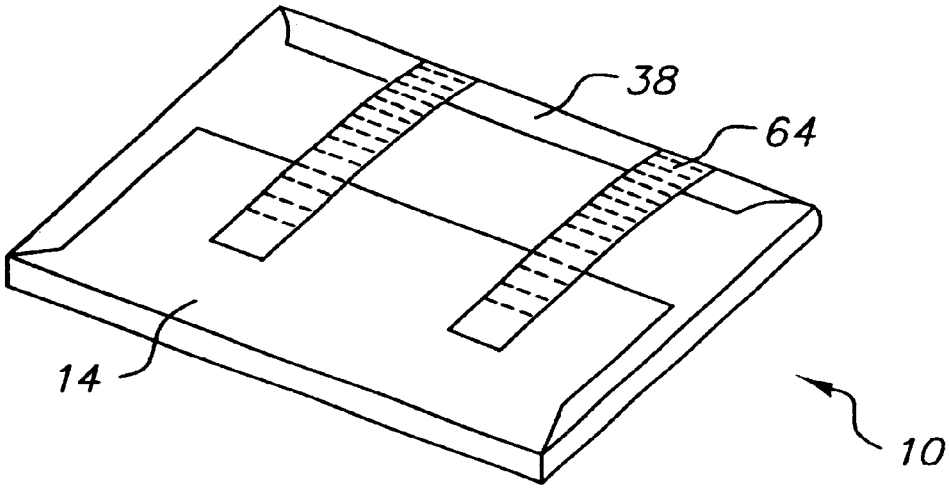
FIG. 17 shows a perspective view of a package in accordance with the present invention having a closure member comprising a plurality of perforation areas.

If closure member 50 is of a length greater than a width W of package 10, second attachment area 62 of closure member 50 can be applied at the underside of package 10 (i.e., at any location on sheet 18), which for the purposes of this invention is still considered to be closure flap 38. Alternatively, closure member 50 can be folded-back onto itself at closure flap 38, as shown in FIG. 16, using additional adhesive for the folded-back portion.

Closure member 50 may also comprise a plurality of rupturable portion 64 within non-attachment area 61. Such a plurality may be desired if one closure member 50 is being employed for packages of varying widths. With such a plurality, a user may rupture any one of the rupturable portions to release leader 14 and closure flap 38.

Figure 18A:
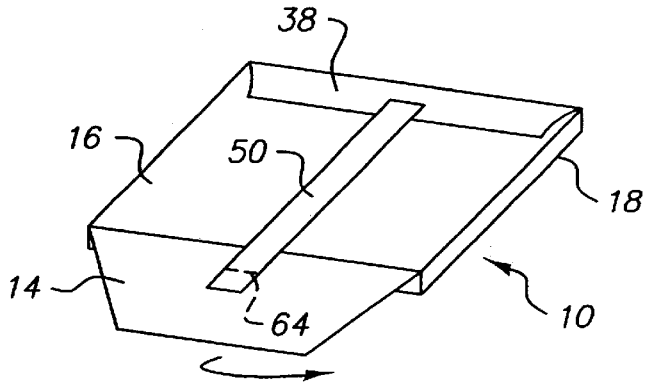
FIGS. 18*a*–18*b* show a perspective view of a package in accordance with the present invention wherein the leader and closure flap are folded on opposite sides of the pouch.
Figure 18B:
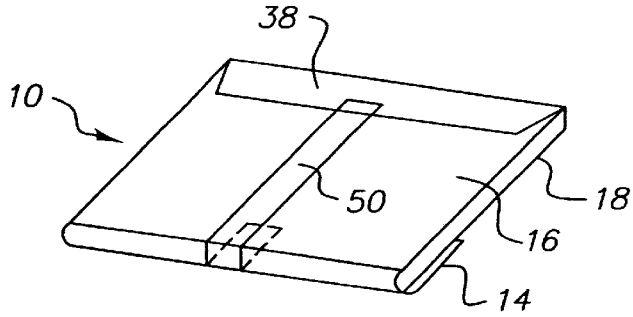

If pouch 12 is of a small size, leader 14 and closure flap 38 could be folded onto opposite sides of pouch 12 so as to not overlap on each other. For example, as shown in FIG. 18*a*–18*b*, closure member 50 is attached to leader 14 and closure flap 38, however, closure flap 38 is folded to overlap sheet 16 while leader 14 is folded to overlap with sheet 18.

Those skilled in the art will recognize that package 10 of the present invention can be employed with magazines and cassettes having a different configuration than shown in FIGS. 15*a*–15*i*, such as those disclosed in U.S. Pat. Nos. 4,909,389 and 4,933,696.

Figure 19A:
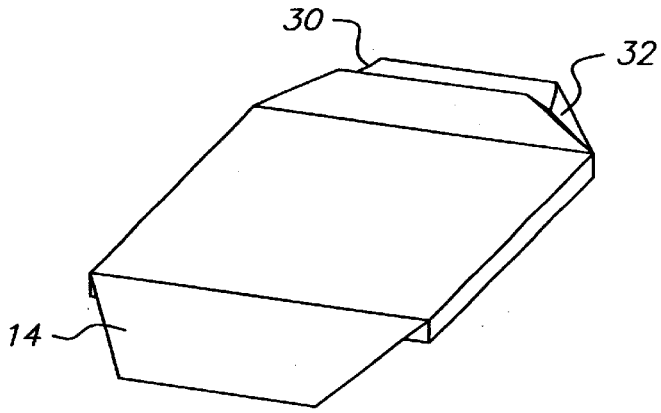
FIGS. 19*a*–19*c* show perspective views of a package in accordance with the present invention illustrating an alternate fold for the open end of the pouch.
Figure 19B:
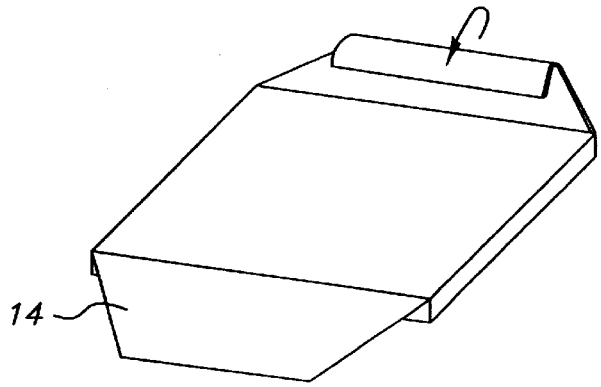
Figure 19C:
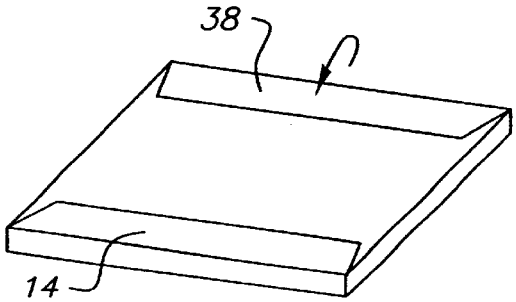
Figure 20:
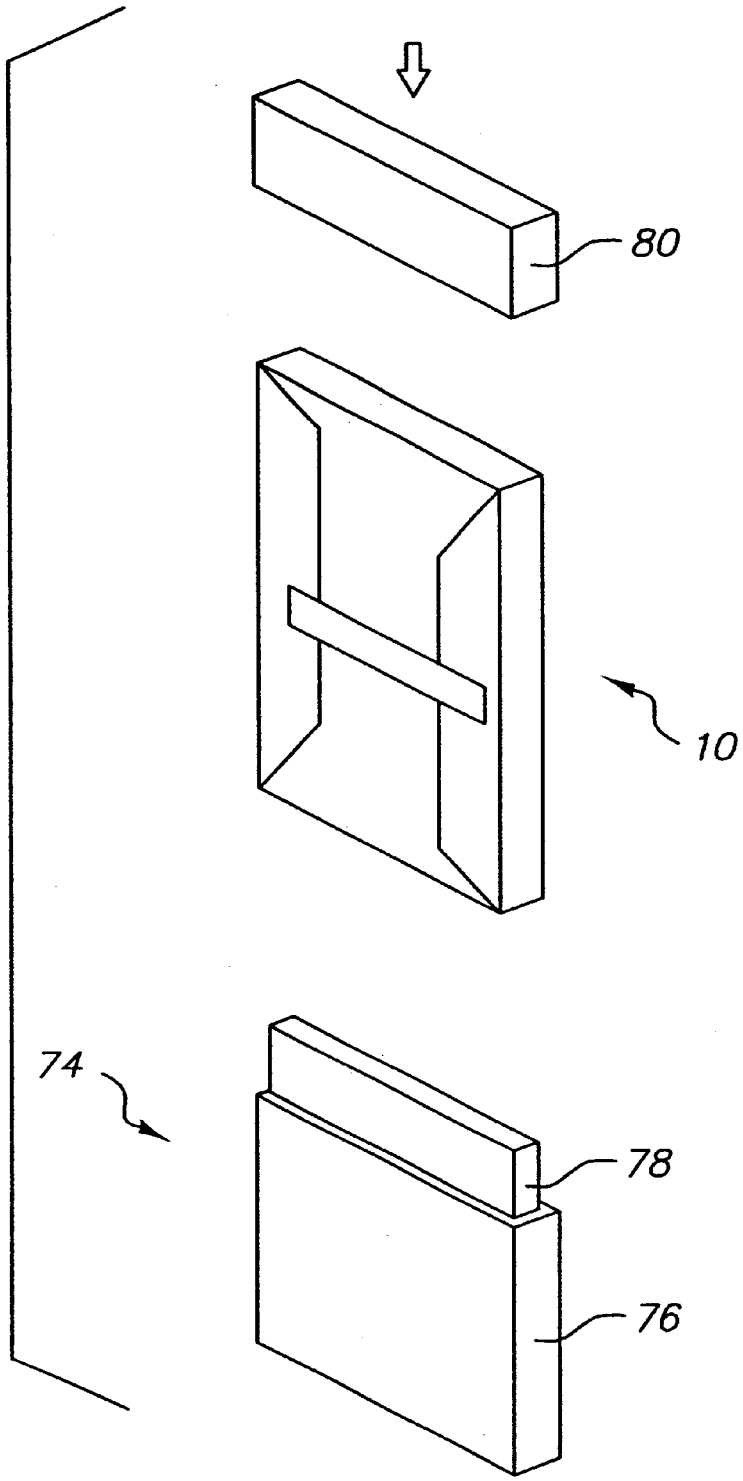
FIG. 20 shows the package of FIG. 9 introduced into a box.

Those skilled in the art will also recognize that other methods for closing opening 20 may be employed. For example, closure flap 38 may be generated as shown in FIGS. 19*a*–19*c*. Side ends 30, 32 are folded inside to create a trapezoidal shape, which is then folded twice to generate closure flap 38.

Rupturable portion 64 may be disposed adjacent second end 54 adjacent second attachment area 62; rupturable portion 64 would not be disposed within second attachment area 62. Though, if disposed at second end 54, rupturable portion 64 may be difficult to access for rupturing when pouch 10 is placed within a magazine/cassette having a joint, such as cassette 70 illustrated in FIGS. 15*a*–15*i*, since closure flap 38 would abut the joint of the cassette.

For ease of transport and delivery, package 10 might be introduced into a box, such as a telescoping box 74 illustrated in FIG. 19. Such a box 74 might comprise a bottom part 76 including a shoulder section 78 fixedly connected therewith, and a top part 80 acting as a lid for box 74 which telescopes over shoulder section 78.

Figure 21:
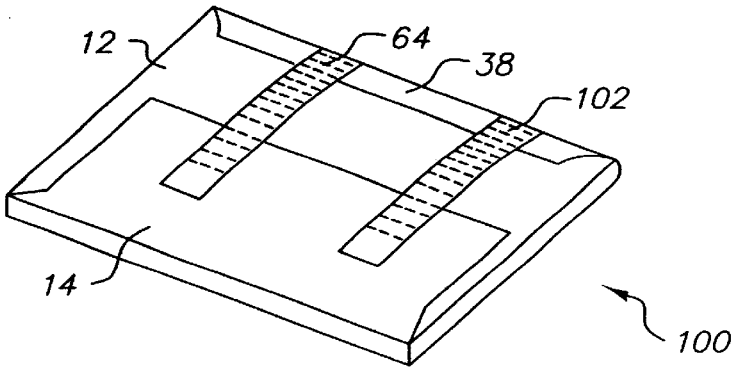
FIG. 21 shows a perspective view of a second embodiment of a package in accordance with the present invention wherein an adhesive is applied along the entire length of the closure member.

FIG. 21 shows a second embodiment of a package in accordance with the present invention. As illustrated, package 100 comprises at least one closure member 102 having a bottom side, with the bottom side of closure member 102 including an adhesive applied thereto along its entire length. Closure member 102 further comprises a plurality of rupturable portions 64. When closure member 102 is applied to package 100, closure member 102 adheres to leader 14, pouch 12, and closure flap 38. Package 100 is positioned within cassette 70 when cassette 70 is in the open position. The user ruptures one rupturable portion 64 of each closure member 50 adjacent leading edge 14. Cassette 70 is closed with leader 14 extending outside of cassette 70. Then, once cassette 70 is inserted into the receiving device, the user pulls leader 14 whereupon another rupturable portion 64 ruptures to free closure flap 38. Applicant has found that, for this embodiment, a rupturable portion adjacent front edge 36 generally ruptures when leader 14 is pulled.

The invention has been described in detail with particular reference to a presently preferred embodiment, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

Parts List

10 package
12 pouch
14 leader
16,18 sheets
20 opening
22 stack
24 folder
30,32 side ends
34 edge
36 front edge
38 closure flap
40 front edge
50 closure member
52 first end
54 second end
56 top side
58 bottom side
60 first attachment area
61 non-attachment area
62 second attachment area
64 rupturing means
70 cassette
71 arrow
72 image
74 box
76 bottom part
78 shoulder section
80 top part
100 package; second embodiment
102 closure member

What is claimed is:

1. A package for enclosing a plurality of sheets, the package comprising:

a pouch adapted to receive the plurality of sheets, the pouch comprising a leading end and open along a trailing end opposite the leading end to receive the plurality of sheets, the trailing end being folded back at least once to form a closure flap to light-tightly close the pouch;

a leader disposed at the leading end of the pouch and folded back onto the pouch; and a closure member having a first end affixed to the leader, a second end affixed to the closure flap, and a rupturable portion disposed adjacent the first end.

2. The package of claim 1, whereby when the rupturable portion is ruptured, the first end separates from the closure member and adheres to the leader and the remaining portion of the closure member adheres to the closure flap by the second end.

3. The package of claim 1, wherein the first end of the closure member includes a first attachment area, the second end the closure member includes a second attachment area, and a non-attachment area is disposed intermediate the first and second attachment areas.

4. The package of claim 3, wherein the first and second attachment areas comprise an adhesive.

5. The package of claim 4, wherein the adhesive is a pressure sensitive adhesive.

6. The package of claim 1, wherein a front edge of the leader is spaced from a front edge of the closure flap.

7. The package of claim 1, wherein the pouch comprises a top face and a bottom face, and the closure flap and leader overlap the top face.

8. The package of claim 1, wherein the pouch comprises a top face and a bottom face, and the closure flap overlaps the top face and the leader overlaps the bottom face.

9. The package of claim 1, wherein the closure member is a single unitary member comprised of polypropylene.

10. The package of claim 1, wherein the rupturable portion comprises perforations.

11. The package of claim 1, wherein the closure member includes an alphanumeric or iconic character, image, or illustration.

12. The package of claim 1, wherein the closure member comprises a plurality of rupturable portions.

13. The package of claim 1, wherein the second end of the closure member is folded back onto itself when affixed to the closure flap.

14. A package for enclosing a plurality of sheets, the package comprising:

a pouch adapted to receive the plurality of sheets, the pouch comprising a leading end and a trailing end opposite the leading end, the pouch being open along the trailing end to receive the plurality of sheets, the trailing end being folded back at least once to form a closure flap to light-tightly close the pouch;

a leader disposed at the leading end of the pouch and folded back onto the pouch; and at least one closure member having a first end, a second end, a top side, and a bottom side, a first attachment area disposed at the first end on the bottom side, a second attachment area disposed at the second end on the bottom side, a non-attachment area disposed on the bottom side intermediate the first and second attachment areas, an adhesive disposed on the first and second attachment areas, and a rupturable portion disposed at the first end adjacent the first attachment area, the first attachment area being adhered to the leader, the second attachment area being adhered to the closure flap, such that when the rupturable portion is ruptured, the first end separates from the closure member and adheres to the leader at the first attachment area and the remaining portion of the closure member adheres to the closure flap at the second attachment area.

15. The package of claim 14, wherein the pouch comprises a top face and a bottom face, and the closure flap and leader overlap the top face of the pouch.

16. The package of claim 14, wherein the pouch comprises a top face and a bottom face, and the closure flap overlaps the top face of the pouch and the leader overlaps the bottom face of the pouch.

17. The package of claim 14, wherein the closure member is a single unitary member comprised of polypropylene.

18. The package of claim 14, wherein the rupturable portion comprises perforations.

19. The package of claim 14, wherein the closure member includes an alphanumeric or iconic character, image, or illustration.

20. The package of claim 14, wherein the adhesive is a pressure sensitive adhesive.

21. The package of claim 14, wherein the closure member comprises a plurality of rupturable portions.

22. The package of claim 14, wherein the second end of the closure member is folded back onto itself when affixed to the closure flap.

23. A package for enclosing a plurality of sheets, the package comprising:

a pouch adapted to receive the plurality of sheets, the pouch comprising a top face, a bottom face, a leading end, and a trailing end opposite the leading end, the pouch being open along the trailing end to receive the plurality of sheets, the trailing end being folded back at least once to form a closure flap to light-tightly close the pouch;

a leader disposed at the leading end of the pouch and folded back onto the pouch; and at least one closure member having a first end, a second end, a top side, a bottom side, an adhesive disposed on the bottom side, and a plurality of rupturable portions disposed between the first end and the second end, the bottom side of the closure member being adhesively affixed to the leader, the top face, and the closure flap.

24. The package of claim 23, wherein the closure flap and leader are folded back to overlap the top face of the pouch.

25. The package of claim 23, wherein the closure flap is folded back to overlap the top face of the pouch and the leader is folded back to overlap the bottom face of the pouch.

26. The package of claim 23, wherein the second end of the closure member is folded back onto itself when affixed to the closure flap.

27. A package for enclosing a plurality of sheets, the package comprising:

a pouch adapted to receive the plurality of sheets, the pouch comprising a leading end and open along a trailing end opposite the leading end to receive the plurality of sheets, the trailing end being folded back at least once to form a closure flap to light-tightly close the pouch;

a leader disposed at the leading end of the pouch and folded back onto the pouch, the leader being spaced from the closure flap; and a closure member having a first end affixed to the leader, a second end affixed to the closure flap, and a rupturable portion which is rupturable to separate the closure member into first and second segments with the first segment adhering to the leader at the first end and the second segment adhering to the closure flap at the second end.

28. The package of claim 27, wherein the rupturable portion is disposed adjacent the first end.

29. The package of claim 27, wherein the rupturable portion is disposed adjacent the second end.

* * * * *